United States Patent [19]

Piorr et al.

[11] Patent Number: 4,719,044

[45] Date of Patent: Jan. 12, 1988

[54] POLYGLYCOL ETHERS CONTAINING AMINO GROUPS AS FOAM-DEPRESSING ADDITIVES IN LOW-FOAM DETERGENT PREPARATIONS

[75] Inventors: Robert Piorr, Ratingen-Hoesel; Gilbert Schenker, Erkrath, both of Fed. Rep. of Germany

[73] Assignee: Henkel Kommanditgesellschaft auf Aktien, Duesseldorf, Fed. Rep. of Germany

[21] Appl. No.: 44,926

[22] Filed: Apr. 30, 1987

[30] Foreign Application Priority Data

May 2, 1986 [DE] Fed. Rep. of Germany ..... 3614834

[51] Int. Cl.[4] ..... C11D 3/30

[52] U.S. Cl. ..... 252/548; 252/529; 252/156; 252/174.21; 252/174.22; 252/321; 252/544

[58] Field of Search ..... 252/174.23, 321, 156, 252/174.21, 544, 525, 548; 564/505

[56] References Cited

U.S. PATENT DOCUMENTS 4,479,887 10/1984 Seibert ..... 252/309
4,522,740 6/1985 Schmid et al. ..... 252/174
4,600,523 7/1986 Piorr et al. ..... 252/174

FOREIGN PATENT DOCUMENTS 2332277 1/1974 Fed. Rep. of Germany .

*Primary Examiner*—Paul Lieberman
*Assistant Examiner*—Isabelle Rodríquez
*Attorney, Agent, or Firm*—Ernest G. Szoke; Henry E. Millson, Jr.; Mark A. Greenfield

[57] ABSTRACT

Hydroxyalkyl polyethylene glycol ethers corresponding to the formula

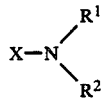

(I)

in which X is $R^3$—CHOH—$CHR^4$—$(OCH_2CH_2)_n$—, $R^1$ is a linear or branched $C_{1-6}$ alkyl, $R^2=R^1$ or X, $R^3$ is a straight-chain $C_{6-18}$ alkyl, $R^4$ is hydrogen or a $C_{1-8}$ alkyl, and and n is an average number of from 3 to 20, with the proviso that the sum of the carbon atoms in $R^3$ and $R^4$ is from 6 to 18, are suitable for depressing foam in detergent preparations.

19 Claims, No Drawings

POLYGLYCOL ETHERS CONTAINING AMINO GROUPS AS FOAM-DEPRESSING ADDITIVES IN LOW-FOAM DETERGENT PREPARATIONS

BACKGROUND OF THE INVENTION

1. Field of the Invention

This invention relates to employing hydroxyalkyl polyethylene glycol ethers containing amino groups as foam-depressing and/or foam-inhibiting additives in low-foam detergent preparations, and to such preparations themselves.

2. Statement of Related Art

Institutional and industrial aqueous detergent preparations, particularly those intended for cleaning metal, glass, ceramic and plastic surfaces, generally contain compounds which are capable of counteracting undesirable foaming. In most cases, the use of foam-depressing additives is necessitated by the fact that the various types of soil detached from the substrates and accumulating in the cleaning baths act as foam generators. In addition, the use of antifoam agents can also be necessitated by the fact that the detergent preparations themselves contain constituents which give rise to undesirable foaming under particular use conditions such as anionic or nonionic surfactants which foam at the use temperature.

DESCRIPTION OF THE INVENTION

Other than in the operating examples, or where otherwise indicated, all numbers expressing quantities of ingredients or reaction conditions used herein are to be understood as modified in all instances by the term "about".

The present invention relates to employing at least one hydroxyalkyl polyethylene glycol aminoether corresponding to formula I below as a foam-depressing additive for low-foam detergent preparations, and to such preparations themselves:

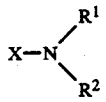

(I)

in this formula, X is $R^3$—CHOH—CH$R^4$—$(OCH_2CH_2)_n$—, $R^1$ is a linear or branched $C_{1-6}$ alkyl, $R^2=R^1$ or X, $R^3$ is a linear $C_{6-18}$ alkyl, $R^4$ is hydrogen or a $C_{1-8}$ alkyl, and n is an average number from 3 to 20, with the proviso that the sum of the carbon atoms in $R^3$ and $R^4$ is from 6 to 18.

Preferred compounds of formula I are derived from alkoxylated dialkylamines, i.e., those in which $R^1$ and $R^2$ are alkyl, especially $C_{3-4}$ alkyl, $R^3$ is a linear $C_{10-16}$ alkyl, $R^4$=H and n is an average number of from 5 to 15. In addition, it is particularly preferred to use those compounds of formula I in which $R^1$ and $R^2$ are n-propyl or n-butyl.

The starting materials used for the preparation of the compounds corresponding to formula I, in which $R^2$=X, are ethoxylated monoalkylamines obtainable by reaction of amines corresponding to formula $R^1$—$NH_2$ with ethylene oxide. Compounds in which $R^1=R^2$ may be obtained from ethoxylated dialkylamines corresponding to the following formula

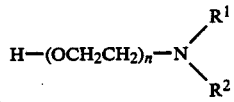

(II)

which in turn are obtained by ethoxylation of the corresponding dialkylamines. Suitable alkyls include methyl, propyl, i-propyl, butyl, i-butyl, amyl, i-amyl and hexyl. Preferred diamines are dipropylamine, diisopropylamine, dibutylamine and diisobutylamine. The mono- or dialkylamines are reacted in known manner with ethylene oxide in a molar ratio of 1:3–20, based on the number of reactive hydrogen atoms.

The ethoxylated mono- or dialkylamines are reacted with $C_{8-20}$ epoxides, preferably in the presence of suitable alkaline catalysts. Both 1,2-epoxides and compounds containing an internal epoxide group may be used. 1,2-epoxides containing from 10 to 16 carbon atoms have proved to be particularly suitable. Mixtures of epoxides of different chain length are also suitable. The molar ratio of ethoxylated monoamine to epoxide is approximately 1:2 and the molar ratio of ethoxylated diamine to epoxide approximately 1:1. The quantity of catalyst added is from 0.1 to 1% by weight, based on the quantity of epoxide used. The reaction is carried out by heating for several hours at temperatures of 140° to 180° C. (preferably 150° to 170° C.). The degree of conversion may readily be determined by determination of the epoxide content of the mixture. Heating for 1 to 3 hours at 150°–170° C. is generally sufficient.

Further information on the reaction of polyglycol ethers with long-chain epoxides can be found in U.S. Pat. No. 4,479,887 (corresponding to published European patent application No. 88,039).

The at least one compound corresponding to formula I may be used alone or in combination with other (auxiliary) foam inhibitors, particularly polyethylene glycol ethers, more particularly a polyglycerol polyethylene glycol alkyl ether, most particularly of the type which may be obtained by addition of from 4 to 20 parts by weight ethylene oxide onto 1 part by weight polyglycerol having a hydroxyl number of from 900 to 1200 and subsequent etherification of the free hydroxyls with $C_{4-8}$ alkyl halides. Examples of such are described in U.S. Pat. Nos. 4,600,523 and 4,522,740 (corresponding to German published patent application No. 33 15 952), both of which are incorporated herein by reference. Mixtures such as these of the polyglycol ethers of formula I and the terminal-group-blocked polyglycerol polyglycol ethers defined above, in a ratio by weight of 1–9:1 (preferably 2.3–9:1), have a particularly unexpected and pronounced foam-depressing effect.

The compounds used in accordance with the invention are liquid at room temperature. They are particularly distinguished by high alkali and acid stability and by very effective foam inhibition in mildly acidic to strongly alkaline detergent solutions.

The detergent preparations in which the compounds of formula I are employed in accordance with this invention may contain constituents typically used in such preparations, including wetting agents, builders and complexing agents, alkalis or acids, corrosion inhibitors and, optionally, antimicrobial agents and/or organic solvents. It must be emphasized that this invention does not relate to any of these typical constituents per se, but does relate (partially) to conventional detergent compositions containing the inventive defoamers. It also must be emphasized that the inventive defoamers are operative in combination with any and all of the disclosed typical constituents.

Suitable wetting agents are nonionic surface-active compounds, such as polyglycol ethers obtained by addition of ethylene oxide onto alcohols, particularly fatty alcohols, alkyl phenols, fatty amines and carboxylic acid amides, and anion-active wetting agents, such as alkali metal, amine and alkylolamine salts of fatty acids, alkyl sulfuric acids, alkyl sulfonic acids and alkylbenzene sulfonic acids.

The detergent preparations may contain as builders and complexing agents above all alkali metal orthophosphates, polymer phosphates, silicates, borates, carbonates, polyacrylates and gluconates and also citric acid, nitriloacetic acid, ethylenediamine tetraacetic acid, 1-hydroxyalkyl-1,1-diphosphonic acids, aminotri(methylenephosphonic acid) and ethylenediamine tetra(methylenephosphonic acid), phosphonoalkane polycarboxylic acids, such as phosphonobutane tricarboxylic acid for example, and alkali metal salts of these acids.

Highly alkaline detergent preparations, particularly those used for bottle washing, contain considerable quantities of caustic alkali in the form of sodium and potassium hydroxide.

If it is desired to obtain particular cleaning effects, the detergent preparations may contain organic solvents, for example alcohols, petroleum fractions and chlorinated hydrocarbons, and free alkylolamines.

In the context of the invention, detergent preparations are understood to be, on the one hand, the aqueous solutions intended for direct application to the substrates to be cleaned. On the other hand, detergent preparations in the context of the invention are also understood to be the concentrates and solid mixtures intended for the preparation of the in-use solutions.

The ready-to-use solutions may be mildly acidic to strongly alkaline.

The compounds of formula I used in accordance with the invention are added to the detergent preparations in such quantities that they are foam-suppressive effective, more specifically that they are present in the ready-to-use solutions in concentrations of 10 to 2500 ppm (preferably 50 to 500 ppm).

EXAMPLES

Preparation of the Hydroxyalkyl Polyglycol Etheramines 349 g (1 mol) of an adduct of 5 mols ethylene oxide with 1 mol dibutylamine, 212 g (1 mol) linear 1,2-epoxytetradecane and 1.3 g sodium ethylate (30% solution in methanol) were heated in vacuo to 100° C. to remove the methanol introduced with the catalyst and then heated with stirring for 2 hours to 160° C. in an inert gas atmosphere. After cooling, the reaction product was neutralized with an equivalent quantity of acetic acid and filtered. (Example 1).

The hydroxyalkyl polyglycol dialkylaminoethers of Examples 2 to 12 were prepared in the same way. They are listed in Table 1 where EO stands for ethylene oxide moieties added.

To prepare the compounds of Example 13, which were derived from monobutylamine, a mixture of 513 g (1 mol) of an n-butylamine (adducted with 10 mols ethylene oxide), with 368 g (2 mols) of a linear 1,2-epoxy-dodecane and 2,5 g sodium methylate was heated for 3 hours at 160°–170° C. in an inert gas atmosphere after removal of the methanol. After cooling to 50° C., the catalyst was neutralized with acetic acid and the product filtered. The products of Example 14 were prepared in the same way.

TABLE 1

| Example No. | Starting materials: Epoxide | Starting materials: Aminoethoxylate | Molar ratio |
|---|---|---|---|
| 1 | 1,2-epoxytetradecane | di-n-butylamine + 5 EO | 1:1 |
| 2 | 1,2-epoxytetradecane | di-n-butylamine + 10 EO | 1:1 |
| 3 | 1,2-epoxytetradecane | di-n-butylamine + 15 EO | 1:1 |
| 4 | 1,2-epoxydodecane | di-n-butylamine + 5 EO | 1:1 |
| 5 | 1,2-epoxydodecane | di-n-butylamine + 10 EO | 1:1 |
| 6 | 1,2-epoxydodecane | di-n-butylamine + 15 EO | 1:1 |
| 7 | 1,2-epoxydodecane | di-n-propylamine + 5 EO | 1:1 |
| 8 | 1,2-epoxydodecane | di-n-propylamine + 10 EO | 1:1 |
| 9 | 1,2-epoxydodecane | di-n-propylamine + 15 EO | 1:1 |
| 10 | 1,2-epoxytetradecane | di-n-propylamine + 5 EO | 1:1 |
| 11 | 1,2-epoxyoctane | di-n-butylamine + 5 EO | 1:1 |
| 12 | 1,2-epoxyhexadecane | di-n-butylamine + 5 EO | 1:1 |
| 13 | 1,2-epoxydodecane | monobutylamine + 10 EO | 1:2 |
| 14 | 1,2-epoxytetradecane | monobutylamine + 10 EO | 1:2 |

Preparation of the Terminal-Group-Blocked Polyglycerol Polyethylene Glycol Ethers According to U.S. Pat. No. 4,522,740 (Incorporated Herein by Reference)

137 g polyglycerol (hydroxyl number 961) were reacted in an autoclave at 180° C./10 bar with 1488 g ethylene oxide (ratio by weight 1:10.9) in the presence of 3 g sodium methylate. 1313 g polyglycerol ethylene glycol ether having a hydroxyl number of 113 were obtained.

350 g of the product obtained, 171 g n-hexylchloride, and 228 g 75% by weight sodium hydroxide solution were stirred for 4 hours at 120° C. The aqueous phase was separated off from the cooled reaction mixture. The organic phase was washed with water at 50° C. until the washing liquid showed a neutral reaction. Unreacted hexylchloride and water were removed from the reaction mixture by heating in vacuo to 150° C. 281.5 g polyglycerol polyethylene glycol hexylether (polyglycerol—10.9 EO-butyl) were obtained. The hydroxyl number of the product was 3.5. The reaction product is referred to hereinafter as product B in Examples 18 and 19.

Testing of the Defoaming Effect of the Inventive Compounds

The antifoaming effect was tested using test solutions containing 1% by weight sodium hydroxide and 0.03% by weight (300 ppm) defoaming agent. In the tests, triethanolamine tetrapropylene benzene sulfonate was added to these solutions as test foaming agent in quantities increasing in stages of 100 ppm.

Quantities of 200 ml of the test solutions were tested at 65° C. in the foam beating apparatus according to DIN (German Industrial Norm) 53,902. In each case, the foam volume in ml was read off 5 seconds after a series of 100 beats in 100 seconds. An average value was determined from 5 individual measurements for each concentration of test foaming agents. From the results obtained, the foam volume observed at a concentration of the test foaming agent of 1000 ppm is shown in the second column of Table 2 below. The concentration of test foaming agent at which a foam volume of more than 200 ml was measured for the first time is shown as a second representative measured value in the third column of Table 2.

TABLE 2

| Defoaming agent of Example No. | Ml. foam at 1000 ppm test foaming agent | Ppm test foaming agent for 200 ml foam |
|---|---|---|
| 1 | 25 | 2300 |
| 2 | 35 | 1400 |
| 3 | 45 | 1400 |
| 4 | 40 | 1800 |
| 5 | 100 | 1300 |
| 6 | 35 | 1500 |
| 7 | 25 | 1700 |
| 8 | 100 | 1400 |
| 9 | 110 | 1200 |
| 10 | 25 | 1800 |
| 11 | 45 | 1400 |
| 12 | 35 | 1500 |
| 13 | 40 | 1300 |
| 14 | 35 | 1200 |

EXAMPLE 15

A typical storable, solid bottle washing detergent was prepared by mechanically mixing the following components (pbw=parts by weight):

80 pbw caustic soda
12 pbw sodium tripolyphosphate
5 pbw sodium silicate (molar ratio $Na_2O:SiO_2=3.35$)
3 pbw product of Example 1

Using a 1% by weight solution of this detergent, milk bottles were washed at 80° C. in a commercial bottle washing machine with one liquor zone and a capacity of 18,000 bottles per hour. The cleaning effect was good and no troublesome foaming was observed.

EXAMPLE 16

A typical storable, solid active-component mixture was prepared by mechanically mixing the following components:

80 pbw sodium tripolyphosphate
20 pbw product of Example 6

Beer bottles were washed at 85° C. in a bottle washing machine with three liquor zones and a capacity of 80,000 bottles per hour. The beer bottles were labeled with paper labels using a casein glue which would normally produce heavy foaming in the immersion baths. When 1.5% by weight sodium hydroxide containing 0.15% by weight of the active-component mixture described above was used as the washing solution, the machine could be operated without any troublesome foaming.

EXAMPLE 17

A typical storable active-component mixture was prepared by mechanically mixing the following components:

40 pbw sodium ethylenediamine tetraacetate
20 pbw sodium tripolyphosphate
30 pbw sodium gluconate
10 pbw product of Example 1

Wine bottles were washed at 85° C. in a commercial bottle washing machine with two separate liquor zones and a capacity of 24,000 bottles per hour. 1.5% sodium hydroxide to which 0.5% by weight of the above-described concentrate had been added was used as the washing solution. Washing was completed without troublesome foaming and the bottles put through the machine were satisfactorily clean.

EXAMPLE 18

A typical detergent concentrate was prepared by dissolving the following components in phosphoric acid:

5 pbw aminotri-(methylenephosphonic acid)
10 pbw 1-hydroxyethane-1,1-diphosphonic acid
5 pbw phosphonobutane tricarboxylic acid
27 pbw product of Example 1
3 pbw product B (see preparation, supra)
10 pbw ethanol
40 pbw phosphoric acid, 75% by weight Mineral water bottles were washed at 80° C. in a conventional bottle washing machine with three liquor zones. The detergent solution used was a 2% by weight sodium hydroxide to which 0.1% by weight of the above-described concentrate had been added. Cleaning was completed without troublesome foaming and the bottles put through the machine were satisfactorily clean.

EXAMPLE 19

A typical storable detergent for the spray cleaning of metal surfaces was prepared by mechanically mixing the following components:

80 pbw sodium metasilicate pentahydrate
16 pbw sodium tripolyphosphate
4 pbw cocosamine+12 EO
1 pbw product of Example 1

The foaming and foam collapse of a 2% by weight solution of this detergent were tested in accordance with DIN 53,902 at 60° C. by comparison with a detergent of the same composition, but without the addition of the product of E. The results are shown in Table 3 below.

TABLE 3

| Detergent | Ml. foam after mins. 0 | 1 | 2 | 10 |
|---|---|---|---|---|
| Comparison | 530 | 140 | 0 | 0 |
| Invention | 160 | 10 | 0 | 0 |

EXAMPLE 20

A typical degreasing dip for metals was prepared by mechanically mixing the following components:

40 pbw sodium metasilicate pentahydrate
35 pbw sodium carbonate
20 pbw sodium tripolyphosphate
2.5 pbw sodium alkylbenzene sulfonate
2.5 pbw nonylphenol+14 EO
4.5 pbw product of Example 1
0.5 pbw product B (see preparation, supra)

Grease-soiled steel shapes were cleaned by dipping in a 4% by weight solution of this detergent at 60° C. The degreasing effect was very good and no troublesome foaming was observed.

EXAMPLE 21

A typical storable concentrate for cleaning metal surfaces was prepared by dissolving the following components in water:

30 pbw sodium caprylate
10 pbw borax
14 pbw sodium tripolyphosphate
10 pbw triethanolamine
2 pbw monoethanolamine
6 pbw product of Example 1

78 pbw water

Iron surfaces were sprayed with a 1.5% by weight solution of this detergent (pH value 8.5) at 50° to 55° C. The cleaning effect was good and no troublesome foaming was observed.

EXAMPLE 22

A storable concentrate for cleaning metal surfaces was prepared by dissolving the following components in water:

25 pbw diethanolamine salt of isononanoic acid 20 pbw diethanolamine 1 pbw benztriazole 4 pbw product of Example 6

50 pbw water

Grey iron castings were sprayed with a 1% solution of this detergent at 50° to 55° C. The cleaning effect was good and no troublesome foaming was observed.

We claim:

1. A method for depressing foam in detergent preparations comprising adding to said preparations a foam-depressing-effective amount of at least one compound of the formula

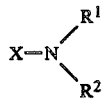

I wherein:

X is $R^3$—CHOH—$CHR^4$—$(OCH_2CH_2)_n$—;

$R^1$ is a linear or branched $C_{1-6}$ alkyl;

$R^2$ is $R^1$ or X;

$R^3$ is a linear $C_{6-18}$ alkyl;

$R^4$ is H or a $C_{1-8}$ alkyl; and n is an average number of about from 3 to 20;

with the proviso that the sum of the carbon atoms in $R^3$ and $R^4$ is of about from 6 to 18.

2. The method of claim 1 wherein $R^1$ and $R^2$ are a $C_{3-4}$ alkyl.

3. The method of claim 1 wherein $R^3$ is a linear $C_{10-16}$ alkyl.

4. The method of claim 1 wherein $R^4$ is H.

5. The method of claim 1 wherein n is an average number from 5 to 15.

6. The method of claim 1 wherein $R^1$ and $R^2$ are a $C_{3-4}$ alkyl, $R^3$ is a linear $C_{10-16}$ alkyl, $R^4$ is H, and n is an average number of about from 5 to 15.

7. The method of claim 1 wherein at least one polyethylene glycol ether is added as an auxiliary foam inhibitor in an auxiliary-foam-inhibitive-effective amount.

8. The method of claim 1 wherein at least one polyglycerol polyethylene glycol alkyl ether is added as an auxiliary foam inhibitor in an auxiliary-foam-inhibitive-effective amount.

9. The method of claim 1 wherein at least one polyethylene glycol ether obtained by addition of from 4 to 20 parts by weight ethylene oxide onto 1 part by weight polyglycerol having a hydroxyl number of from 900 to 1200 and subsequent etherification of the free hydroxyls with $C_{4-8}$ alkyl halides, is added as an auxiliary foam inhibitor in an auxiliary-foam-inhibitive-effective amount.

10. The method of claim 9 wherein the ratio by weight of said formula I compound to said ether is about 1–9:1.

11. The method of claim 9 wherein the ratio by weight of said formula I compound to said ether is about 2.3–9:1.

12. The method of claim 6 wherein at least one polyethylene glycol ether obtained by addition of from 4 to 20 parts by weight ethylene oxide onto 1 part by weight polyglycerol having a hydroxyl number of from 900 to 1200 and subsequent etherification of the free hydroxyls with $C_{4-8}$ alkyl halides, is added as an auxiliary foam inhibitor in an auxiliary-foam-inhibitive-effective amount.

13. The method of claim 12 wherein the ratio by weight of said formula I compound to said ether is about 1–9:1.

14. The method of claim 12 wherein the ratio by weight of said formula I compound to said ether is about 2.3–9:1.

15. A detergent preparation resulting from the method of claim 1.

16. A detergent preparation resulting from the method of claim 2.

17. A detergent preparation resulting from the method of claim 5.

18. A detergent preparation resulting from the method of claim 9.

19. A detergent preparation resulting from the method of claim 12.

* * * * *